US005897482A

United States Patent [19]

Lowe

[11] Patent Number: 5,897,482

[45] Date of Patent: Apr. 27, 1999

[54] ROTOR LID TIE-DOWN AND VACUUM VENTING SYSTEM

[75] Inventor: Winston H. H. Lowe, Sunnyvale, Calif.

[73] Assignee: Beckman Instruments, Inc., Fullerton, Calif.

[21] Appl. No.: 09/034,706

[22] Filed: Mar. 4, 1998

[51] Int. Cl.[6] ..... B04B 7/06; B04B 5/02

[52] U.S. Cl. ..... 494/12; 494/16; 494/38; 411/424

[58] Field of Search ..... 494/12, 16, 20, 494/33, 38, 39, 61, 64, 85; 81/177.1; 411/383, 385, 395, 424

[56] References Cited

U.S. PATENT DOCUMENTS

| | | | |
|---|---|---|---|
| 3,819,111 | 6/1974 | Romanauskas et al. . | |
| 3,961,745 | 6/1976 | Wright . | |
| 4,010,890 | 3/1977 | Wright . | |
| 4,344,563 | 8/1982 | Romanauskas . | |
| 4,360,151 | 11/1982 | Cowell et al. . | |
| 4,412,830 | 11/1983 | Strain et al. | 494/12 |
| 4,435,169 | 3/1984 | Romanauskas . | |
| 4,753,631 | 6/1988 | Romanauskas | 494/12 |
| 4,850,951 | 7/1989 | Cheng et al. | 494/16 |
| 5,344,380 | 9/1994 | Chern et al. | 494/12 |

FOREIGN PATENT DOCUMENTS

| | | | |
|---|---|---|---|
| 2907789 | 8/1979 | Germany | 494/12 |

*Primary Examiner*—Charles E. Cooley
*Attorney, Agent, or Firm*—William H. May; P. R. Harder; Thomas Schneck

[57] ABSTRACT

A rotor lid assembly for a rotor body comprises a lid portion having a centrally depending shank. A bore formed through the shank receives a tie-down stem having a diameter smaller than the bore. A piston-like portion disposed along the stem contacts a periphery of the bore. A venting channel is formed along the shank to allow fluidic flow to and from the bore. The piston portion occludes such flow when the stem is in a first position and permits fluid flow when the stem is in a second position. In one embodiment the lid assembly comprises a lid member and a safety knob, each having a central neck portion and a bore formed therethrough with the neck portion of the knob received in the bore of the lid. A venting channel is formed through both neck portions. A tie-down stem is received in the bore of the knob. The rotor lid assembly provides venting of the rotor body when a negative pressure is created within a chamber of the rotor body and provides a safe venting direction when a positive pressure develops in the rotor chamber so venting can occur without risk to an operator.

21 Claims, 5 Drawing Sheets

ROTOR LID TIE-DOWN AND VACUUM VENTING SYSTEM

TECHNICAL FIELD OF THE INVENTION

The present invention relates to centrifuge systems and more specifically to an apparatus for locking down rotor lids with a vacuum-tight closure and venting capability.

BACKGROUND

Large centrifugation systems typically use a rotor for holding sample containers which contain the sample to be separated. The rotor is covered by a rotor lid and then placed into an instrument chamber wherein the rotor is spun during centrifugation. Typically, the instrument chamber is evacuated for the centrifugation run to reduce the effects of windage and heat generation.

If the rotor lid is properly sealed, then the air within the interior chamber of the sealed rotor remains at atmospheric pressure and does not leak into the evacuated instrument chamber. Upon completion of the centrifugation run, the instrument chamber is vented back to atmospheric pressure and the rotor lid is easily removed from the rotor.

However, if the rotor lid seals are not properly maintained or if the seals have been compromised, then air from the interior chamber of the rotor will escape and leak into the evacuated instrument chamber during a centrifugation run. This creates a low pressure system within the rotor. When the instrument chamber is returned to atmospheric pressure, this pressure will push the lid tightly onto the rotor body thus creating a vacuum locked lid.

A good seal of the rotor lid is also desirable in order to prevent leakage of the material undergoing centrifugation. This is especially important where toxic and other biohazardous materials are concerned. If breakage occurs within the rotor chamber, the analyte may spill and/or release hazardous vapors, resulting in a positive pressure within the rotor chamber. Such vapors may release in a violent manner when the rotor lid is removed, exposing laboratory personnel to harmful material.

It is therefore desirous to have a rotor lid system which can provide venting in situations where a negative pressure is created within the rotor chamber. It is also desirable that the rotor lid system provide a safe venting direction in cases where a positive pressure develops within the rotor chamber so that venting of hazardous materials can occur without risk to the user.

SUMMARY OF THE INVENTION

A rotor lid assembly in accordance with the present invention comprises a lid having a centrally depending neck portion. A bore is formed through the lid and through the length of the neck portion. A tie-down stem is received within the bore and has a diameter less than that of the bore. One or more venting ports are formed in the neck portion, thus providing a fluid channel from within the bore. The tie-down stem includes a hermetic member disposed therealong, contacting a periphery of the bore and providing an air-tight seal therewith while at the same time allowing for a sliding action of the stem within the bore. When the tie-down stem is in a first position, the hermetic member is aligned with the venting ports thereby preventing fluidic flow therethrough. When the tie-down stem is in a second position, the hermetic member is displaced relative to the venting ports thus permitting fluidic flow through the ports.

In another embodiment of the invention, the lid assembly comprises a lid having a centrally depending shank and a bore formed through the lid and the shank. A safety knob is provided, also having a centrally depending shank. The shank of the safety knob is received in the bore of the lid. The shank of the safety knob has a bore formed therethrough which receives a tie-down stem in the manner as described above. Both shanks have venting ports aligned to allow fluidic flow from within the shaft of the second shank.

The hermetic member may comprise a protuberant annular portion of the tie-down stem, contacting a periphery of the bore. Alternatively, the hermetic member comprises an annular member made of material such as leather and disposed about the stem. Yet another alternative is a pair of spaced-apart O-rings which straddle the venting port(s) when the stem is in the first position, thus preventing fluid flow beyond the small volume enclosed by the O-rings.

BEST MODE OF CARRYING OUT THE INVENTION

Figure 1A:
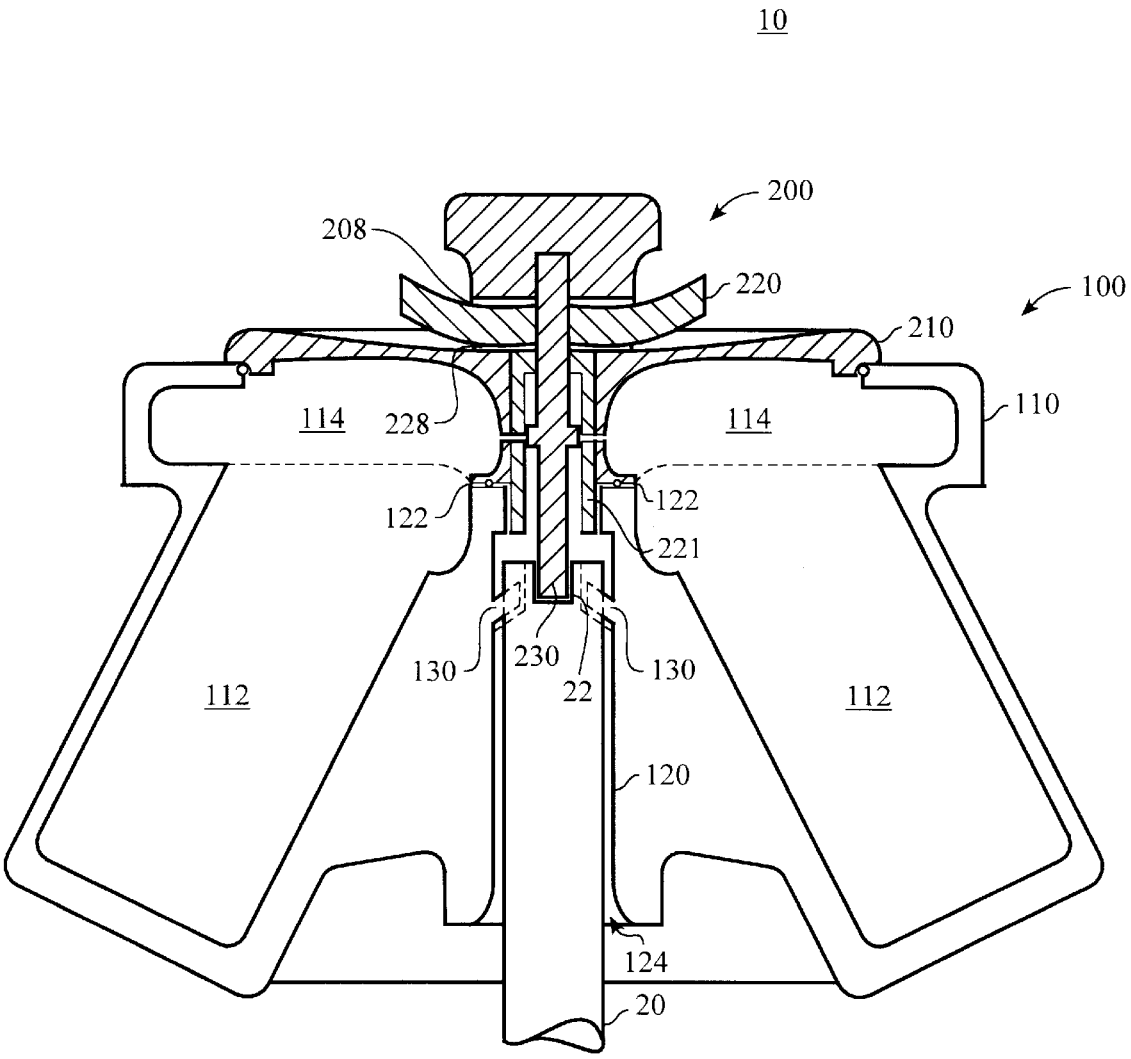
FIGS. 1A and 1B are cross sectional views of a rotor assembly.

Referring to FIG. 1A, a rotor assembly 10 comprises a rotor 100 and a rotor lid assembly 200 which seals the contents in the rotor during centrifugation. Rotor 100 in turn comprises a rotor body 110 which has a rotor chamber consisting of a plurality of canister chambers 112 for receiving centrifugation sample containers (not shown) which hold the sample being centrifuged and an interior upper chamber 114. Interior chamber 114 is the volume which remains within the rotor chamber after insertion of the centrifugation containers. Rotor body 110 includes an axial bore 120 formed through the spin axis of the rotor body, extending from an open end 122 within interior chamber 114 to an open end 124 at the bottom of the rotor body. Axial bore 120 includes one or more locking pins 130 which project into the interior volume of the axial bore.

Setting up the rotor assembly for a centrifugation run includes placing rotor 100 into an instrument chamber (not shown). The instrument chamber includes a spindle 20 which is received in axial bore 120 of rotor body 110. The inserting end of spindle 20 is slotted to engage locking pins 130, thus locking the spindle into position relative to the rotor body. Spindle 20 is coupled to a drive motor (not shown) which provides the torque to spin the rotor.

Figure 2:
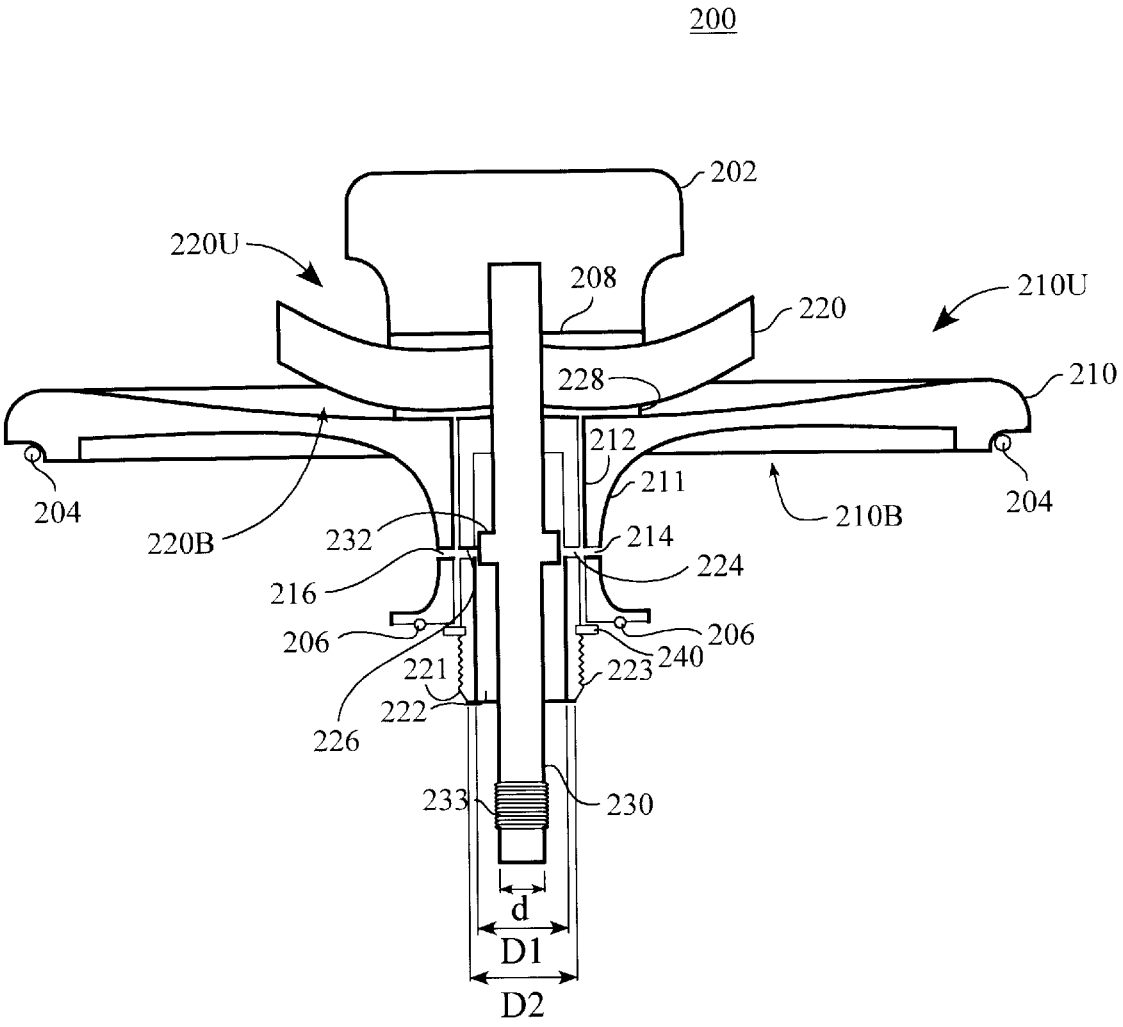
FIG. 2 is a cross sectional view of a dual-locking lid version of the rotor lid assembly in accordance with the present invention.

Referring to FIG. 2, the rotor lid assembly 200 comprises a first lid 210 having an upper major surface 210U and an opposed bottom major surface 210B. A shank (neck portion) 211 depends from the bottom surface of lid 210. A bore 212 is formed through the lid, extending from upper surface 210U through the length of shank 211. A gasket member 204 such as an O-ring is disposed about the periphery of lid 210 to provide a seal with rotor body 110 (FIG. 1A). The length of shank 211 is such that when the rotor is sealed by the cap assembly, a distal end of the shank contacts a surface of open end 122 of axial bore 120. A gasket 206 is disposed at the distal end of shank 211 to provide a seal with the surface of the open end 122 when such contact occurs.

A safety knob 220 comprises an upper major surface 220U and an opposed bottom major surface 220B. Safety knob 220 includes a shank 221 depending from bottom surface 220B and a bore 222 extending from upper surface 220U through the length of bore 222. As can be seen in FIG. 2, the safety knob presses down onto lid 210 and serves to provide a dual locking function in conjunction with knob 202. This dual locking feature will be discussed further below.

Shank 221 of safety knob 220 is received within bore 212 of the first lid 210, thus forming a dual-locking lid combination. Bore 212 has a diameter D2 along its entire length which is sufficient to receive shank 221. Using a light coat of vacuum grease, an air-tight seal can be provided between shank 221 and bore 212 and yet permit a sliding action therebetween.

A distal end of shank 221 includes a threaded section 223. At the upper portion of threaded section 223 an annular notch is formed in shank 221 to receive a retaining ring 240. As can be seen in FIG. 2, retaining ring 240 serves to hold lid 210 in position along shank 221 to prevent the lid from sliding off the shank when lid assembly 200 is being transported.

A tie-down stem 230 is received within bore 222 of safety knob 220. Tie-down stem 230 has a diameter d that is less than a diameter D1 of bore 222. Bore 222 narrows to a diameter d along a portion proximate safety knob 220 in order to provide a slidable yet air-tight fit therebetween when a small amount of vacuum grease is applied. Tie-down stem 230 extends above upper surface 220U of the safety knob for attachment of a knob 202. Tie-down stem 230 includes a threaded end 233 distal to knob 202.

A washer seal 228 is disposed on bottom surface 220B and fits around shank 221. The seal is attached to bottom surface 220B. Similarly, a second washer seal 208 is disposed on a bottom surface of knob 202, and fits around tie-down stem 230. As will be explained below these washers provide a seal when lid assembly 200 is in a locked-down position.

Shank 211 includes a vent channel (venting port) 214 extending between the bore 212 and the outer surface of the shank. Similarly, shank 221 includes a vent channel (venting port) 224 extending from the outer surface thereof to the bore 222. Vent channels 214, 224 are co-aligned along their respective shanks, thus providing a fluid channel from within bore 222 to the external atmosphere. As can be seen in FIG. 2, additional vent channels 216 and 226 may be formed in shanks 211 and 221 respectively.

Tie-down stem 230 includes a piston-like portion 232 which contacts a periphery of bore 222. Piston-like portion 232 is disposed along tie-down stem 230 so that when the stem is in a first position the piston-like portion is co-located with vent channels 214, 224 so as to prevent continuous fluidic flow from bore 222 via the vent channels. Conversely, when tie-down stem 230 is in a second position, piston portion 232 is dislocated relative to vent channels 214, 224 thus allowing fluidic flow through the vent channels.

Referring to FIGS. 1A and 2, tie-down stem 230 is shown in the first position. Rotor lid assembly 200 is locked down to seal rotor 100 by engaging tie-down stem 230 with spindle 20, such as by screwing the stem into the spindle or by some similar interlocking method. It can be seen in FIGS. 1A and 2 that in the locked down position, interior chamber 114 is fully sealed off. First, there are the two gasket seals, one provided by gasket 204 at the periphery of lid 210 and the other by gasket 206 at open end 122 into axial bore 120. A second seal is provided by piston-like portion 232 of tie-down stem 230 to seal off vent channels 214, 224, 216, 226. A third seal is provided by washer seal 228 when safety knob 220 is tightened down upon lid 210. The washer seal serves to seal off the small gap between the bore 212 of lid 210 and shank 221 of the safety knob. A fourth seal is similarly provided by washer seal 208 when knob 202 is tightened down. In this case, washer seal 208 provides a seal of the small gap formed between the bore 222 through the safety knob and tie-down stem 230.

Figure 1B:
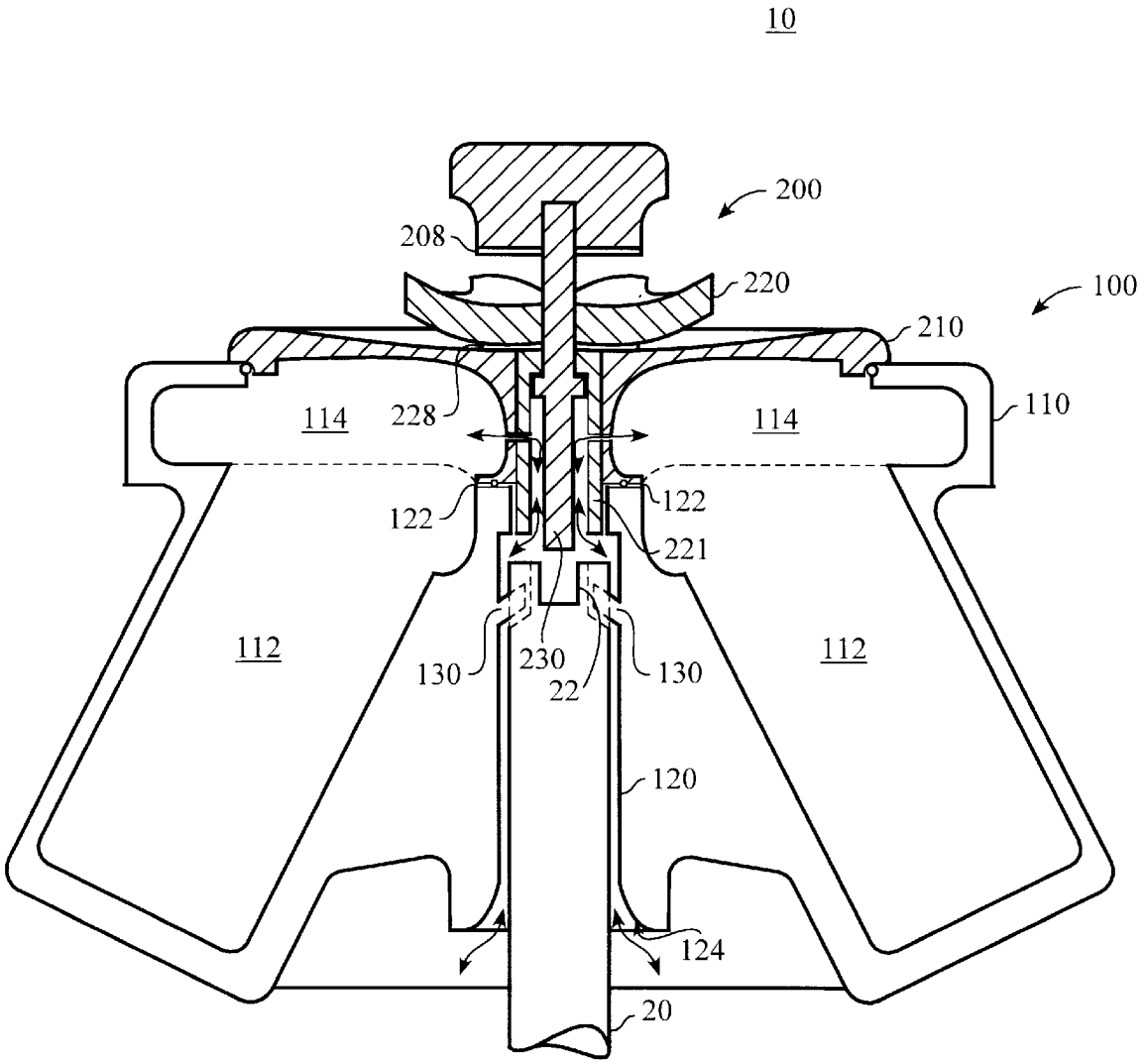

Recall that if air leaks from within rotor assembly 10 into an evacuated instrument chamber (not shown) during centrifugation, due to an improper or compromised seal at either of the two gasket seals for example, then lid assembly 200 will become vacuum locked onto the rotor 100 when atmospheric pressure is re-established in the instrument chamber. However, when the lid assembly is unlocked by disengaging tie-down stem 230 from spindle 20, as shown in FIG. 1B where the stem is moved to the second position, the vent channels are exposed. Thus, air from the instrument chamber enters the rotor via open end 124 at the bottom, flows along axial bore 120 and into bore 222 of shank 221, and vents into interior chamber 114, thus equalizing the pressure between the interior chamber and the instrument chamber. Once equilibrium is reached, lid assembly 200 can be easily removed from rotor 100.

Conversely, where breakage occurs within the rotor chamber during centrifugation, or some other process occurs which increases the pressure within interior chamber 114, the venting channels provide a fluidic path from the interior chamber to open end 124 at the bottom of the rotor. This is especially important where bio-hazardous material is involved. Rather than venting such material through the top of the rotor and exposing lab technicians to hazardous conditions, the lid assembly of the present invention vents the material safely into the instrument chamber. This is a safety feature not found in prior art rotor lid assemblies.

The lid assembly shown in FIG. 2 is a dual-locking lid variety which permits the lid to remain in a locked down configuration even when the tie-down stem is disengaged from the spindle. As can be seen in FIG. 1A a portion of shank 221 is received in axial bore 120 of the rotor body 110. Where shank 221 contacts rotor body 110, an interlocking interface (such as the threaded portion 223) is provided so that lid assembly 200 can be secured directly to the body of the rotor independently of whether tie-down stem 230 is coupled with spindle 20. The dual-locking lid assembly, therefore, provides two lock down mechanisms.

Figure 3:
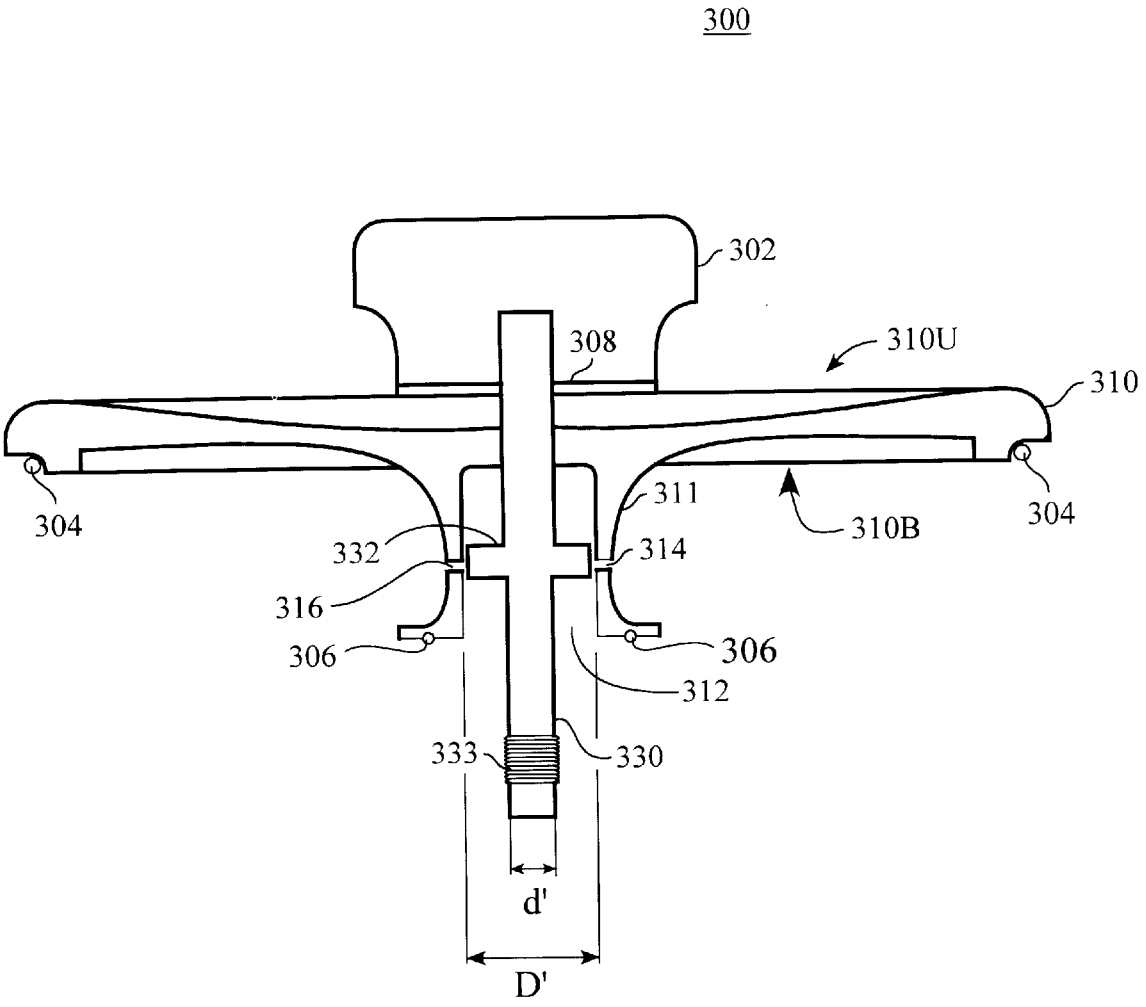
FIG. 3 is a cross sectional view of a single-lid version of the rotor lid assembly in accordance with the present invention.

Referring to FIG. 3, a single-locking lid version 300 of the lid assembly in accordance with the present invention comprises the same elements as shown in FIG. 2 with the exception that there is no safety knob. Thus, lid 310 comprises upper and bottom major surfaces, 310U and 310B respectively. A neck portion 311 extends from bottom surface 310B. A central bore 312 extends from upper surface 310U through neck portion 311. A tie-down stem 330, received in bore 312, has a first diameter d' that is less than the diameter D' of the bore. A venting port 314 is provided along neck portion 311 to allow fluidic flow from within bore 312. One or more additional venting ports 316 may be provided in the neck portion. Tie-down stem 330 includes a hermetic member 332 disposed therealong and a threaded end 333. When tie-down stem 330 is in a first position, hermetic member 332 prevents fluid flow via the venting ports 314 and 316. When the tie-down stem is in a second position, hermetic member 332 is moved out of the way thus permitting flow through the venting ports.

Returning to FIG. 2, the piston portion 232 is depicted as a protuberant annular portion of tie-down stem 230, having a diameter sufficiently close to diameter D1 as to provide an air-tight contact with the periphery of bore 222 with an application of a light coat of vacuum grease and yet allow a sliding action of the tie-down stem within the bore. Moreover, the annular portion is positioned along tie-down stem so as to occlude vent channel 214 when the tie-down stem is in the first (locked down) position.

Figure 4A:
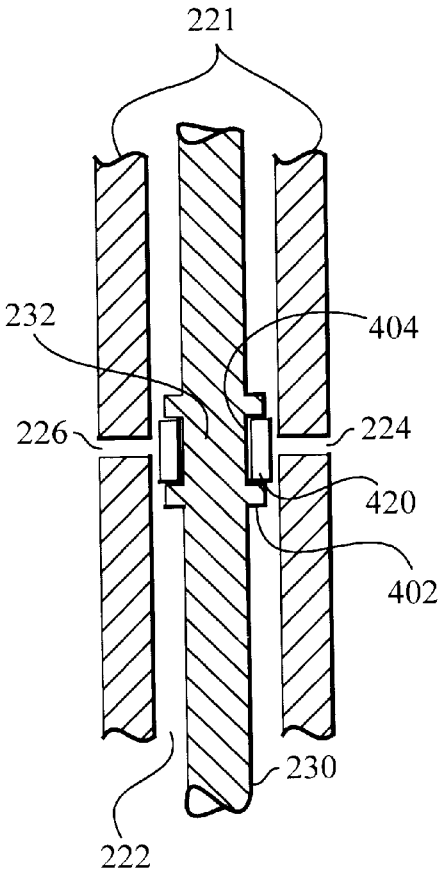
FIGS. 4A and 4B show alternate embodiments of the tie-down stem.
Figure 4B:
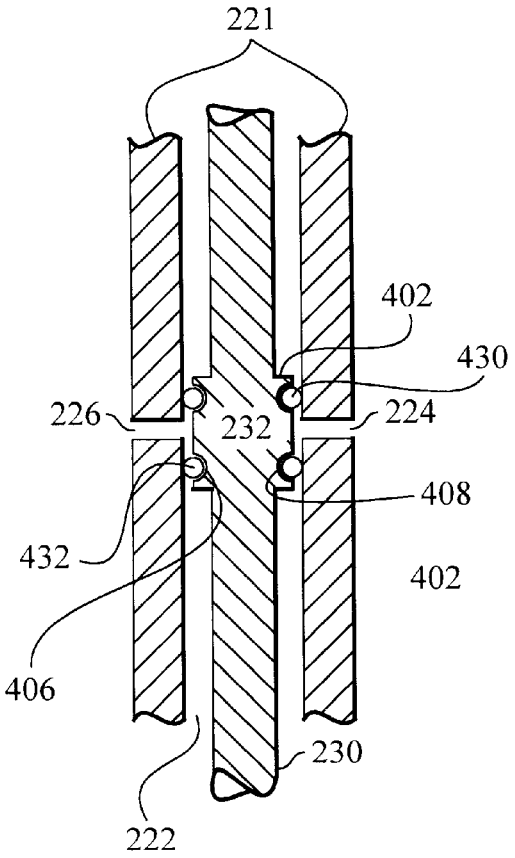

Refer now to FIGS. 4A and 4B for alternate embodiments of tie-down stem 230. In FIG. 4A, piston-like portion 232 of the tie-down stem comprises an expanded portion 402 circumferentially formed upon a segment of the stem. The expanded portion has a recessed channel 404 which receives an annular sleeve 420. Typically, the sleeve is of a non-metallic material such as leather for high vacuum pressure conditions (roughly ¼ atmosphere within the rotor chamber) where a higher quality seal is required. FIG. 4B shows a pair of spaced apart O-rings 430 and 432, each received in a groove 406 and 408 formed in expanded portion 402 of the stem. Here, the O-rings are spaced apart so as to straddle the vents 224, 226 when the stem is in the locked down position. Thus, rather than directly occluding the vents as in the case of the other embodiments, the O-rings provide a seal occluding fluidic flow in bore 222 by sealing the bore slightly above and below the vents. The use of O-rings is appropriate for vacuum pressures less than ¼ atmosphere within the rotor chamber.

I claim:

1. A rotor lid assembly comprising:

a cover plate having opposed first and second major surfaces and a neck portion depending from the second major surface along a central axis of the cover plate, the cover plate further having a bore extending from the first major surface through the length of the neck portion, the neck portion having a channel extending from an exterior surface thereof to the bore; and a stem disposed within the bore and having a diameter less than a diameter of the bore, the stem having a piston-like member disposed therealong and contacting a periphery of the bore, the stem further having a first position wherein the piston-like member obstructs fluidic flow through the channel and a second position wherein the piston-like member is displaced from the channel to allow fluidic flow through the channel.

2. The rotor lid assembly of claim 1 wherein the piston-like member is an annular protuberance of the stem having a diameter greater than the diameter of the stem sufficient to occlude the channel when the stem is in the first position thereby providing a fluid-tight seal of the channel.

3. The rotor lid assembly of claim 1 wherein the piston-like member comprises a pair of spaced apart O-rings, the O-rings straddling the channel when the stem is in the first position.

4. The rotor lid assembly of claim 1 wherein the piston-like member includes an annular sleeve disposed about the stem, the annular sleeve being of a material different from that of the stem.

5. The rotor lid assembly of claim 1 wherein the neck portion further includes a second channel, the two channels being disposed in diametric opposition to each other.

6. A rotor lid assembly comprising:

a lid having opposed first and second major surfaces, a first depending portion extending from the second major surface along a central axis of the first lid, and a first bore extending from the first major surface and through the first downwardly depending portion;

a safety knob having opposed third and fourth major surfaces, a second depending portion extending from the fourth major surface along a central axis of the safety knob, and a second bore extending from the third major surface and through the second downwardly depending portion, the second downwardly depending portion co-axially disposed within the first bore;

a stem disposed within the second bore and having a diameter smaller than a diameter of the second bore;

the first and second depending portions having a first port formed therethrough, thereby providing a fluid channel from within the second bore;

the stem having a fluid-tight seal member disposed therealong, the fluid-tight seal member preventing a continuous flow of fluid through the port only when the stem is in a first position within the second bore.

7. The rotor lid assembly of claim 6 wherein the fluid-tight seal member is an annular member contacting a periphery of the second bore, thereby occluding the port when the stem is in the first position to provide a fluid-tight seal of the port.

8. The rotor lid assembly of claim 7 wherein the annular member includes a material different from that of the stem.

9. The rotor lid assembly of claim 6 wherein the fluid-tight seal member comprises a pair of spaced apart O-rings contacting a periphery of the second bore, the O-rings straddling the port when the stem is in the first position.

10. The rotor lid assembly of claim 6 wherein the first and second depending portions have a second port formed therethrough, thereby providing a second fluid channel from within the second bore.

11. The rotor lid assembly of claim 10 wherein the ports are disposed in diametric opposition to each other.

12. In a rotor assembly comprising (i) a rotor body having opposed upper and lower ends, the upper end having an opening into an interior chamber of the rotor body, the rotor body further having an axial first bore extending between an open end in the interior chamber and the lower end of the rotor body, (ii) a lid assembly to cover the opening of the upper end, and (iii) a spindle received in the axial bore; the lid assembly comprising:

a lid having a centrally depending shank with a second bore formed therethrough to abut the open end of the axial first bore thereby sealing the interior chamber and providing a fluidic path between the second bore and the axial bore in the rotor body, the second bore having a first diameter along a length thereof; and a stem disposed within the shank to engage the spindle, the stem having a second diameter less than the first diameter of the second bore;

the shank having a venting port at a portion thereof within the interior chamber of the rotor body to provide a fluidic path from the interior chamber to the axial first bore;

the stem having a hermetic member, the hermetic member being disposed along the stem in a manner as to prevent continuous fluid flow between the interior chamber and the axial first bore when the stem is in engagement with the spindle and to allow continuous fluid flow between the interior chamber and the axial first bore when the stem is disengaged from the spindle.

13. The lid assembly of claim 12 wherein the hermetic member is an annular member contacting a periphery of the second bore to provide a fluid-tight seal of the venting port when the stem is in engagement with the spindle.

14. The lid assembly of claim 13 wherein the annular member includes a material different from that of the stem.

15. The lid assembly of claim 12 wherein the hermetic member is a pair of spaced apart O-rings, each O-ring contacting a periphery of the second bore, the spaced apart O-rings straddling the venting port when the stem is in engagement with the spindle.

16. The lid assembly of claim 12 wherein the shank further includes a second venting port, the two venting ports being disposed in diametric opposition to each other.

17. In a rotor assembly comprising (i) a rotor body having opposed upper and lower ends, the upper end having an opening into an interior chamber of the rotor body, the rotor body further having an axial first bore extending between an open end in the interior chamber and the lower end of the rotor body, (ii) a lid assembly to cover the opening of the upper end, and (iii) a spindle received in the axial bore; the lid assembly comprising:

a knob having a centrally depending shank with a second bore formed therethrough to abut the open end of the axial first bore thereby sealing the interior chamber and providing a fluidic path between the second bore and the axial first bore in the rotor body, the second bore having a first diameter along a length thereof;

a lid having a diameter greater than that of the knob having a depending shank with a third bore formed therethrough, the shank of the knob being received within the third bore; and a stem disposed within the second bore to engage the spindle, the stem having a second diameter less than the first diameter of the second bore;

the shanks of the knob and the lid having a venting port at portions thereof within the interior chamber of the rotor body to provide a fluidic path from the interior chamber to the axial first bore;

the stem having a hermetic member, the hermetic member being disposed along the stem in a manner as to prevent continuous fluid flow between the interior chamber and the axial first bore when the stem is in engagement with the spindle and to allow continuous fluid flow between the interior chamber and the axial first bore when the stem is disengaged from the spindle.

18. The lid assembly of claim 17 wherein the hermetic member is an annular member contacting a periphery of the second bore to provide a fluid-tight seal of the venting port when the stem is in engagement with the spindle.

19. The lid assembly of claim 18 wherein the annular member includes a material different from that of the stem.

20. The lid assembly of claim 17 wherein the hermetic member is a pair of spaced apart O-rings, each O-ring contacting a periphery of the second bore, the spaced apart O-rings straddling the venting port when the stem is in engagement with the spindle.

21. The lid assembly of claim 17 wherein the shanks of the lid further include a second venting port, the two venting ports being disposed in diametric opposition to each other.

* * * * *